US006390051B2

(12) United States Patent
Hilpert et al.

(10) Patent No.: US 6,390,051 B2
(45) Date of Patent: May 21, 2002

(54) CYLINDER HEAD EXHAUST GAS PASSAGE

(75) Inventors: Ulrich Hilpert, Wernau; Manfred Meyer, Esslingen, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/829,056

(22) Filed: Apr. 9, 2001

(30) Foreign Application Priority Data

Apr. 11, 2000 (DE) ..... 100 17 968

(51) Int. Cl.[7] ..... F02F 1/00
(52) U.S. Cl. ..... 123/193.5
(58) Field of Search ..... 123/193.5, 193.3

(56) References Cited

U.S. PATENT DOCUMENTS 2,260,656 A * 10/1941 Bell ..... 123/193.5
3,983,696 A * 10/1976 Pfugfelder ..... 123/193.5
4,031,699 A * 6/1977 Suga et al. ..... 123/193.5
4,089,163 A * 5/1978 Yamazaki et al. ..... 123/193.5
4,120,154 A * 10/1978 Yokota ..... 123/193.5
4,195,477 A * 4/1980 Yamazaki et al. ..... 123/193.5
4,195,478 A * 4/1980 Rao et al. ..... 123/193.5
4,430,856 A * 2/1984 Niedert ..... 123/193.5

FOREIGN PATENT DOCUMENTS

DE 26 17 938 11/1976

* cited by examiner

*Primary Examiner*—Marguerite McMahon
(74) *Attorney, Agent, or Firm*—Klaus J. Bach

(57) ABSTRACT

In a cylinder head of an internal combustion engine with a cylinder head casting having at least one exhaust passage formed from thin-walled material, which together with the cylinder head casting forms an annular space filled with molding sand, the exhaust passage being supported in the cylinder head casting by sheet-like mounting flanges, a venting duct is provided which extends from the annular space to the outside for discharging gases released from the molding sand in the annular space during casting of the cylinder head.

3 Claims, 2 Drawing Sheets

CYLINDER HEAD EXHAUST GAS PASSAGE

BACKGROUND OF THE INVENTION

The invention relates to a cylinder head of an internal combustion engine with a cylinder head casting and at least one exhaust gas passage formed from thin-walled material, which, together with the cylinder head casting, forms an annular space partially filled with core sand, the exhaust gas passage being mounted in the cylinder head casting by means of sheet-like mounting flanges cast into the cylinder head.

A cylinder head of an internal combustion engine with an exhaust passage formed from sheet metal and separated from the cylinder head casting by an annular space is disclosed by DE 26 17 938.

The hot gases escaping from the core sand in the annular space around the sheet metal duct forming the exhaust gas passage when the cylinder head is being cast are conducted through the core sand along the exhaust gas passage outwardly through the sand core at the exhaust side. The gases flow, by way of a narrow cross-section, namely the cross-section of the annual space minus the cross-sectional area occupied by sand particles. At the exit from the cylinder head the cross-section of the core sand, and hence also the flow cross-section for the gases, is once again significantly reduced by the mounting flanges of the sheet metal duct.

In the casting areas around the valve seat of the cylinder head, which are far removed from the points at which the gases released from the core sand leave the cylinder head, there is an increased risk that shrinkage cavities form in the cast material. However, because in these areas the material is subjected to high stresses, a casting grain structure free of shrinkage cavities is required particularly in the area around the valve seat, which area forms a part of the combustion chamber boundary.

It is further disadvantageous that, in the area of the exhaust flange, the gap is open to the ambient air.

It is the object of the invention provide a cylinder head with sheet metal exhaust gas passages surrounded by core sand wherein the venting of the gases released from the core sand from the annular space around the sheet metal duct forming the exhaust gas passage is facilitated, in order to prevent any formation of shrinkage cavities in the cylinder head area.

SUMMARY OF THE INVENTION

In a cylinder head of an internal combustion engine with a cylinder head casting having at least one exhaust passage formed from thin-walled material, which together with the cylinder head casting forms an annular space partially filled with molding sand, the exhaust passage being supported in the cylinder head casting by sheet-like mounting flanges, a venting duct is provided which extends from the annular space to the outside for discharging gases released from the molding sand in the annular space during casting of the cylinder head.

In an internal combustion engine of a motor vehicle the exhaust emission limits are strictly defined. In order to adhere to these limits it is an advantage if the catalytic converters, which are provided for this purpose in the exhaust duct, reach their operating temperature as rapidly as possible. For this to happen it is necessary that little heat be removed from the exhaust gas, that less heat pass to the cooling water through the port liner or sheet metal duct and that more heat be delivered to the exhaust turbocharger and/or the catalytic converter.

This is achieved within the cylinder head by heat-insulated exhaust passages, so-called port liners. The port liners may consist of ceramic. Also, the exhaust passages may be constructed of thin metal (high-temperature sheet metal) and provided with an insulating layer of air, which forms an annular space between the exhaust port and the cylinder head casting.

The insulating layer of air is produced during manufacturing of the cylinder head, in that a thin layer of core sand is placed around the preformed exhaust passages. The layer of core sand is removed, once the cylinder head casting has cooled, for example at the same time as the core sand of the so-called water core is removed when fettling the rough casting. One or more connections of the sand core to the inset core of the cylinder head are necessary for this purpose. The inset core may be the core on the exhaust side, the combustion chamber side or the oil chamber side, for example.

A further reason for a connection of the internal sand core, which is intended to provide for the insulating air layer, to an inset core resides in the need to create a means for venting gases from the sand core. At the high casting temperatures, both, the air between the individual grains of sand and the binder in the molding sand, release gases, which must be able to escape easily and rapidly from the part being cast. If this is not ensured, gas bubbles, so-called shrinkage cavities, may form in the cast material. In a highly stressed structural component such as a cylinder head any area in the structure, which is subjected to high mechanical or thermal stresses, must be cast free of shrinkage cavities.

This means that the venting duct must have as large a cross-section as possible. The venting duct, or the sand core forming the venting duct, is advantageously arranged as centrally as possible in the core to be vented, in this case the sand core forming the annular space around the exhaust port. As a result of the short distances venting, even of the end areas of the sand core arranged around the exhaust port, is facilitated.

The exhaust passage consisting of a thin material is cast into the cylinder head with flange-like members disposed in the area of the valve seat and the valve guide structure. Because there may be differences in the rate of thermal expansion between the exhaust passage (material: sheet steel, for example) and the cylinder head casting (material: an aluminum or cast iron alloy, for example), it may be necessary to support the exhaust flange end of the exhaust passage, which is relatively remote from the valve area, by means of a movable support structure, for example, by way of a sliding fit in a cast-in sheet metal flange.

A thin layer of air is sufficient in order to reduce the heat losses in the exhaust passage. A thin-walled sand core may result in the sand becoming caked during casting of the cylinder head so that it cannot be completely removed during fettling of the cylinder head. Meticulous and hence costly fettling work, which is absolutely essential for the water spaces and oil ducts in the cylinder head, may be dispensed with for the annular space around the exhaust passages and the venting duct. The insulating characteristic of the annular space around the exhaust port is not significantly impaired by the presence of any residual sand.

In order to permit efficient venting of the annular space around the exhaust passage when casting, it is advantageous to extend the venting duct upward in the casting position of the cylinder head. If the cylinder head is cast with the combustion chamber side downwards (usual method of casting), the venting duct extends upwardly in the outer mold of the entire cylinder head core assembly. In another casting position, a corresponding procedure is followed.

After casting and fettling of the unfinished cylinder head, the venting duct is sealed. Sealing is necessary, since exhaust gases might get into the annular space through the sliding fit that possibly exists at the exhaust flange end. Any passage of exhaust gases into the oil chamber or into other areas of the engine is inadmissible. Since molding sand is present in the annular space and in the venting duct and may be shaken loose by engine movements, the venting duct is also to be sealed in order to prevent any migration of sand grains into any other area of the engine.

Sealing of the venting duct is performed as the first operation after fettling. Any escape of sand grains needs to be prevented not only during engine running but also during measuring and machining of the cylinder head casting, since grains of sand can adversely affect the functioning of the measuring machines and precision machining equipment. That is to say the venting duct is sealed before leaving the fettling shop, so that no grains of sand can fall out of the duct during subsequent machining.

The closure member for the venting duct is a simple stopper, sealing cap (known, for example, as a core hole cap) or a plug. These sealing elements are held in the cylinder head by a press fit, or they are welded to the cylinder head. This sealing can be performed in the foundry area of which the fettling shop is part.

A venting duct according to the invention can be used both in the case of one exhaust passage and also in the case of multiple exhaust passages per cylinder. If there are two exhaust passages per cylinder, for example, the two passages usually extend side by side, so that the annular spaces for the insulation merge. This permits the use of a common sand core, which is provided with a common venting duct.

A preferred embodiment of the invention is explained below in greater detail with reference to the accompanying drawings:

DESCRIPTION OF A PREFERRED EMBODIMENT

Figure 1:
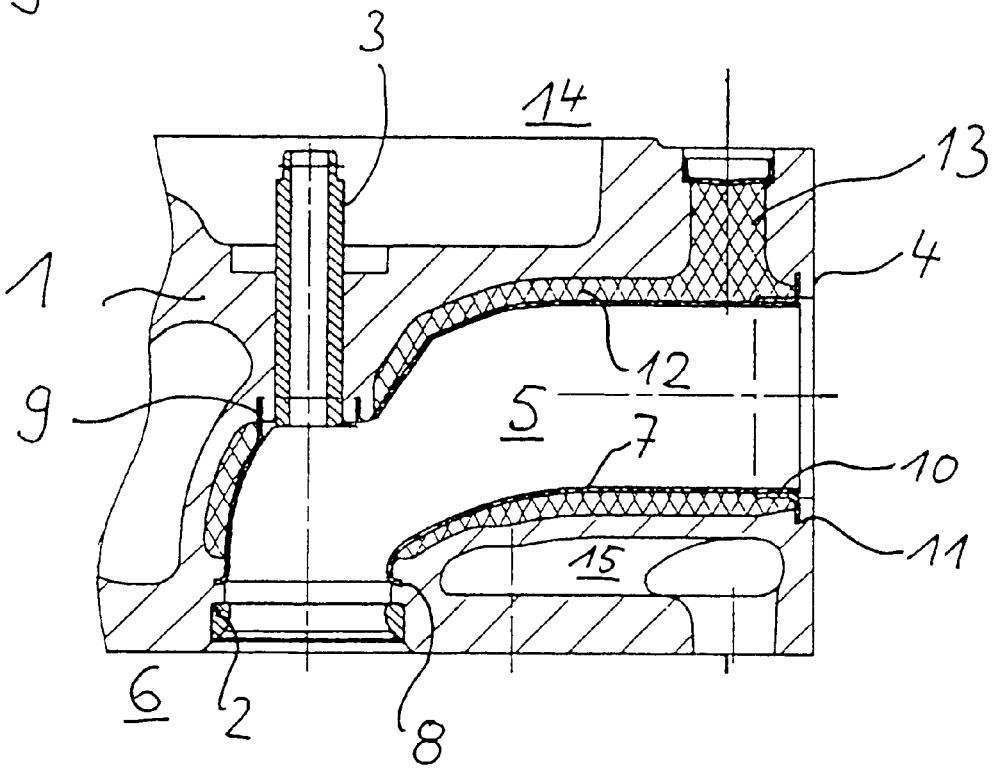
FIG. 1 is a partial cross-sectional view of a cylinder head casting showing an exhaust passage.

As shown in FIG. 1, a cylinder head 1 contains a valve seat 2 and a valve guide 3 for an exhaust valve (not shown), an exhaust flange 4 and an exhaust passage or port 5, which runs in an arc from the valve seat at the combustion chamber 6 to the exhaust flange. The exhaust passage 5 is formed by a thin-walled material 7, which, in the area of the valve seat 2 and the valve guide 3, is cast into the cylinder head 1 by means of sheet-like mounting flanges 8, 9. At the exhaust flange end of the exhaust passage 5 is supported in a mounting flange 11 by means of a slide fit bearing support structure 10. The mounting flange 11 is cast into the cylinder head 1.

Except in the immediate proximity of the mounting flanges 8, 9, 11, an annular space 12 filled with air and residual molding sand is provided around the exhaust passage 5.

From the annular space 12 a venting duct 13 extends upwards outside the oil chamber 14. The venting duct 13 is sealed at its oil chamber end. Extending the venting duct 13 upwards assumes that the cylinder head 1 is being cast in a position in which the combustion chamber 6 is disposed at the bottom and the oil chamber on top.

There is only a relatively small amount of heat transferred from the exhaust passage 5 to the oil chamber 14, and particularly to the water space 15, because of the insulating layer of air in the annular space 12.

Figure 2:
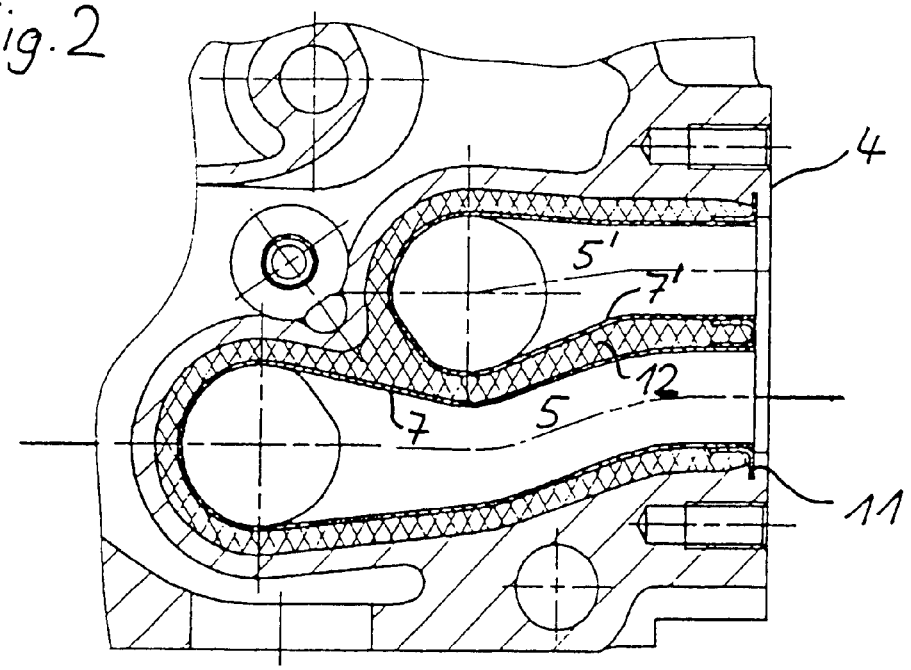
FIG. 2 is a partial cross-sectional view of a cylinder head casting with two exhaust passages on one cylinder.

FIG. 2 shows two adjacent exhaust passages 5 and 5'. The exhaust passages 5 and 5' have merging annular spaces 12. The two thin-walled passage walls 7 and 7' extend separately from one another. In the area of the exhaust flange 4, they are engaged by a common single flange member 11.

Figure 3:
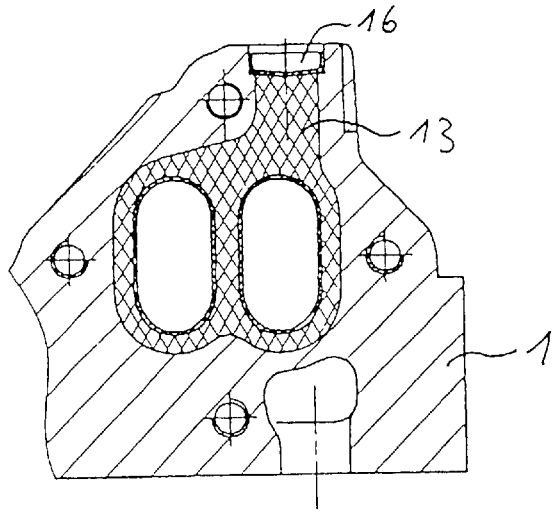
FIG. 3 shows in cross-section the cylinder head casting perpendicular to the direction of two exhaust passages, the venting duct being sealed by a sealing cap.
Figure 4:
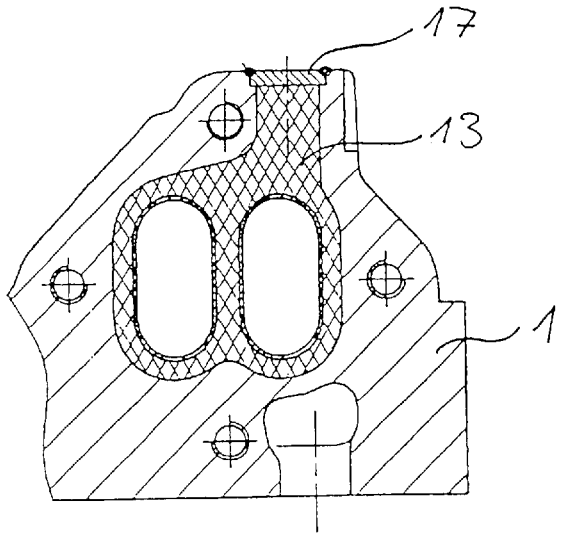
FIG. 4 shows in cross-section the cylinder head casting perpendicular to the direction of two exhaust passages, the venting duct being sealed by a welded-in plug.
Figure 5:
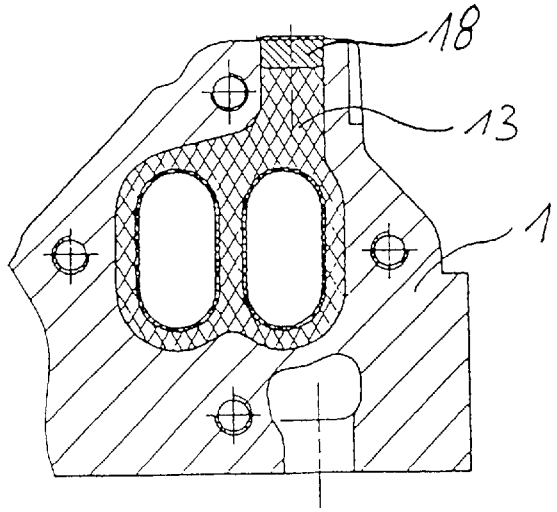
FIG. 5 shows in cross-section through the cylinder head casting perpendicular to the direction of two exhaust passages, the venting duct being sealed by a welded-in stopper.

FIGS. 3 to 5 show different possible methods of sealing the venting duct 13.

In FIG. 3 a sealing cap 16, designed as core hole cap, is provided for closing the venting duct 13.

A possible method of sealing by means of a welded plug 17 shown in FIG. 4 requires little, if any, machining of the cylinder head 1 in the area of the opening of the venting duct 13. The plug is inserted into the venting duct 13, which is provided, for example, with a shoulder to engage the plug. The plug is then welded to the cylinder head 1 in order to seal the venting duct 13 permanently.

FIG. 5 shows a further possible method of sealing the venting duct 13, wherein a stopper 18 is pressed into the duct opening and then welded to the cylinder head 1 as in FIG. 4.

What is claimed is:

1. A cylinder head of an internal combustion engine with a cylinder head casting having at least one exhaust passage formed from thin-walled material extending through the cylinder head, said exhaust passage, together with the cylinder head casting, forming an annular space including molding sand, said exhaust passage having sheet-like mounting flanges cast into the cylinder head casting, said cylinder head casting further including a venting duct extending from the annular space to the outside of the cylinder head casting.

2. A cylinder head according to claim 1, wherein said venting duct for the venting of gases released from the molding sand extends upwardly when said cylinder head casting is disposed in the casting position.

3. A cylinder head according to claim 1, wherein said venting duct is sealed by a sealing element after casting.

* * * * *